United States Patent [19]

Sorenson

[11] 4,378,043

[45] Mar. 29, 1983

[54] PIVOTING SCREEN PANEL FOR SECTIONAL GARAGE DOOR

[76] Inventor: Robert V. Sorenson, 10126 Pine Springs Dr., Sun City, Ariz. 85373

[21] Appl. No.: 266,954

[22] Filed: May 26, 1981

[51] Int. Cl.[3] ..... E06B 3/32

[52] U.S. Cl. ..... 160/97; 160/201

[58] Field of Search ..... 160/88, 89, 90, 92, 160/97, 114, 201, 205

[56] References Cited

U.S. PATENT DOCUMENTS

| | | | |
|---|---|---|---|
| 1,555,308 | 9/1925 | Morgan | 160/92 |
| 2,629,435 | 2/1953 | Dadswell | 160/205 |
| 2,980,182 | 4/1961 | Stroup | 160/201 |
| 3,178,776 | 4/1965 | Stansberry | 160/201 |
| 3,263,734 | 8/1966 | Lister | 160/201 |
| 3,927,709 | 12/1975 | Anderson et al. | 160/201 |
| 4,103,458 | 8/1978 | Booker | 160/97 |

*Primary Examiner*—Peter M. Caun

*Attorney, Agent, or Firm*—H. Gordon Shields

[57] ABSTRACT

A screen panel pivotally secured to the bottom of a sectional screen door selectively pivots downwardly to provide air circulation to a garage or is pivoted upwardly and against the door for closing the garage door.

4 Claims, 6 Drawing Figures

PIVOTING SCREEN PANEL FOR SECTIONAL GARAGE DOOR

BACKGROUND OF THE INVENTION

1. Field of the Invention

This invention relates to garage doors, and more particularly, to sectional garage doors rolling along a fixed track and having a pivoting screen panel at the bottom of the door.

2. Description of the Prior Art

Garage doors are generally of two types, a single, relatively inflexible panel which pivots by means of an arc of about ninety degrees from the vertical, closed position, to a generally horizontal, overhead, open position. The second type of garage door is a sectional door which includes a plurality of articulated panels or sections with rollers on on the outer (side) ends disposed in a track. The sections are secured together by hinged connections which allows them to move on the track from the down position to the up position.

Both types of garage doors are generally solid, although they may include glass panels for viewing through the door. Typically, the doors are made of either metal or wood.

During summer months, particularly, it is highly desirable to allow for the circulation of air through a garage. To accomplish this, the garage door is generally open to its full extent, or partly open, as desired. When a door is open to virtually any extent which is sufficient to allow for the circulation of air, undesirable elements such as animals, leaves, etc. or even humans, such as children or persons with ulterior motives, may also enter into the garage.

To provide for the circulation of air, several alternatives have been suggested. These alternatives relate primarily to providing screens for sectional doors which move on tracks, as opposed to the solid panel, pivoting type door structure. Of the sectional type doors which have directed themselves to the provision of some type of screen apparatus, several have been patented.

One example of a screen apparatus is found in U.S. Pat. No. 3,021,896. This patent discloses a dual, parallel track system for a sectional garage door utilizing a pair of garage doors. One track is for the ordinary, "solid" sectional garage door without screens. The other track is for the screen door. Either one of the doors may be used, but they may not be used together. That is, either the screen door is down, in place, or the "solid" door is in place. The screen door may not be used half way, with the "solid" garage door occupying the other half, or any portion of the "down" position.

Another example is found in U.S. Pat. No. 3,103,967. The '967 patent discloses a dual door system in which a screen door is separately usable from an ordinary, "solid" panel sectional garage door. The two doors may be used at the same time by using a dual system of tracks which are completely independent of each other, and not tied together, as with the apparatus of the '896 patent. With the screen door in place, the "solid" panel garage door may be positioned as desired for air circulation purposes.

U.S. Pat. No. 3,126,944 discloses another type of dual door system, with a fixed frame screen door disposed in front of an ordinary, or "solid" sectional door which moves on a track system. The screen door is of a solid frame construction and accordingly pivots between its full down position and its full up position. With the screen door in the down position, the sectional door may be moved as desired with respect to its vertical height.

Alternatives to the double screen door system discussed in the above three patents are found in three other patents which utilize some type of screen panel. For example, in U.S. Pat. No. 3,178,776, a garage door includes sliding panels which may be selectively changed to comprise window panels, screen panels, or solid panels, as desired.

U.S. Pat. No. 3,927,709 discloses a garage door having a plurality of hinged window panels covering screened openings. The windows may be opened from the inside of the garage by pivoting the window panels on their hinges to present the screened openings for air flow purposes. The window panels must be closed before the garage door can be opened.

U.S. Pat. No. 4,141,403 discloses a plurality of window panels also covering screened openings. The window panels are hinged on the outside of the screen door and on the top of the panels, differently from the inside hinged panels of the '709 patent. In the '403 patent, the windows automatically close when the door is raised to its overhead position, and accordingly do not need to be manually closed, as is required in the '709 apparatus.

It may be understood that the double track system utilizing two separate doors is relatively expensive and also relatively cumbersome to operate. The hinged or screened panel system is also relatively expensive and is somewhat limited with respect to the amount of air circulation allowable. The deficiencies of the prior art are overcome with the apparatus of the present invention, which comprises a separate panel, screened, and which may be selectively utilized at the bottom of an ordinary, sectional garage door.

SUMMARY OF THE INVENTION

The invention described and claimed herein comprises a screen panel pivotally secured to the bottom of a sectional garage door and which may be lowered in place to provide for air circulation in the garage, while maintaining the privacy within the garage of the solid, upper panels of a sectional garage door, and which panel may be selectively pivoted upwardly when its use is not desired, or downwardly when use of the screen panel is desired.

Among the objects of the present invention are the following:

To provide new and useful garage door apparatus;

To provide new and useful sectional garage door apparatus movable on a track system;

To provide new and useful screen apparatus for a garage door;

To provide new and useful garage door apparatus having a screen panel;

To provide new and useful garage door apparatus having a pivoting screen panel; and To provide new and useful garage door apparatus having a pivoting screen panel selectively movable between a down position for allowing air flow in a garage and an up position, with the panel folded out of the way for allowing the garage door to be closed.

DESCRIPTION OF THE PREFERRED EMBODIMENT

Figure 1:
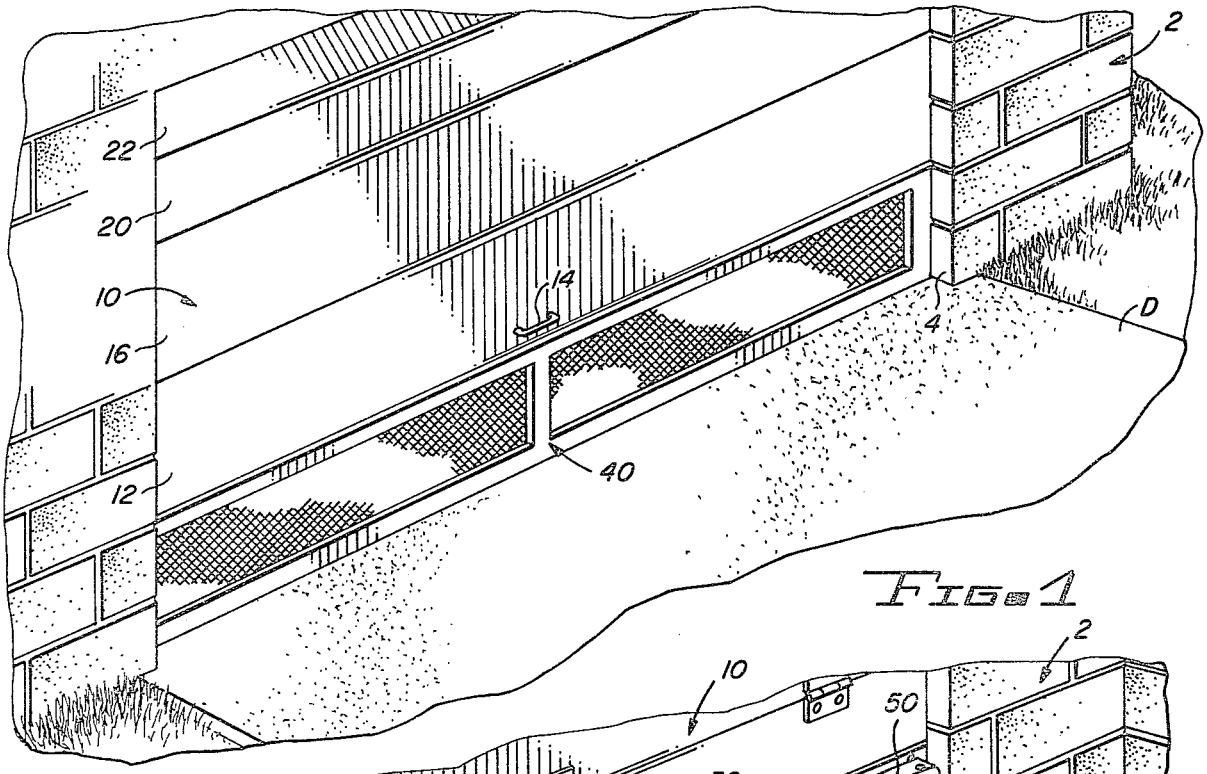
FIG. 1 is a front perspective view of the apparatus of the present invention in its use environment.
Figure 2:
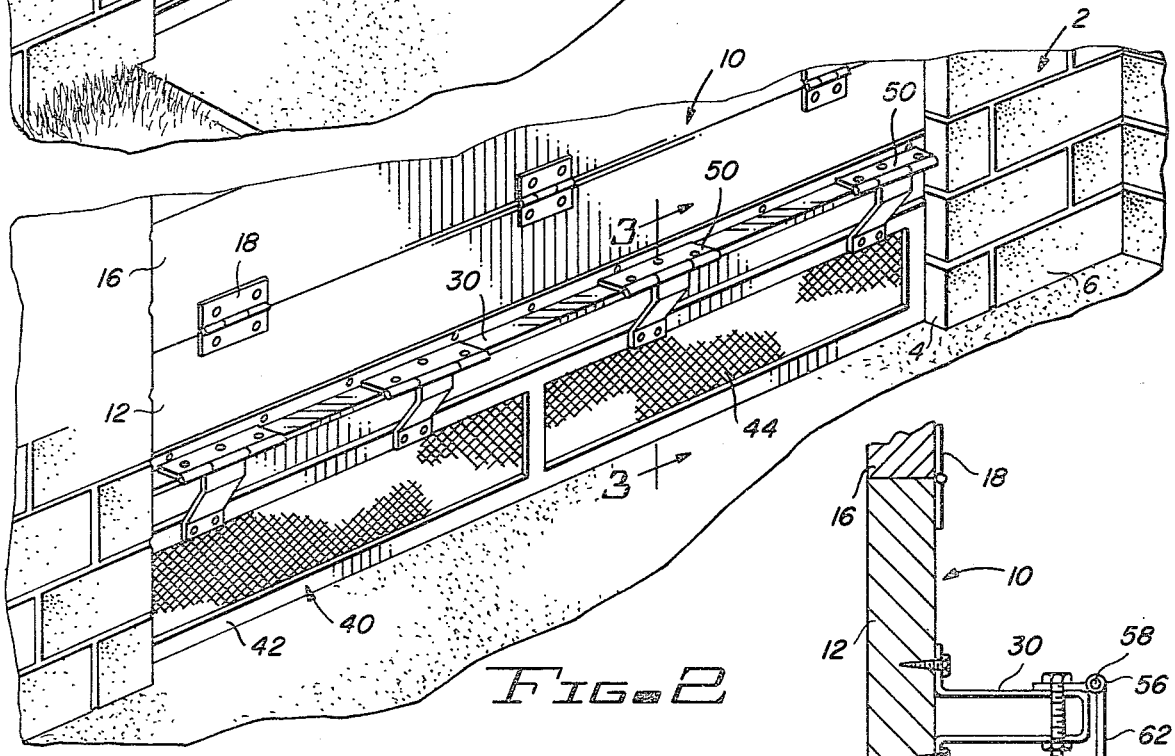
FIG. 2 is a rear perspective view of the apparatus of the present invention in its use environment.
Figure 4:
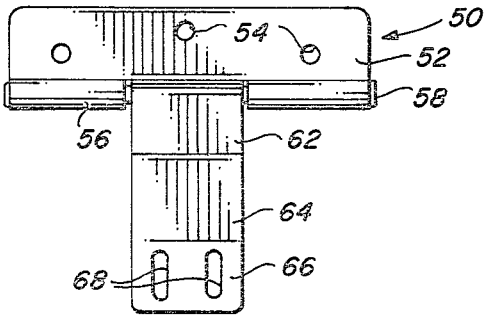
FIG. 4 is a front view of a portion of the apparatus of the present invention.
Figure 3:
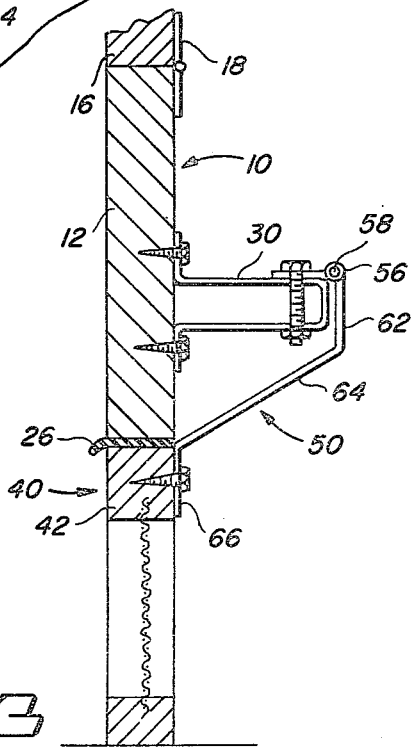
FIG. 3 is a view in partial section of the apparatus of FIG. 2, taken generally along line 3—3 of FIG. 2.
Figure 5:
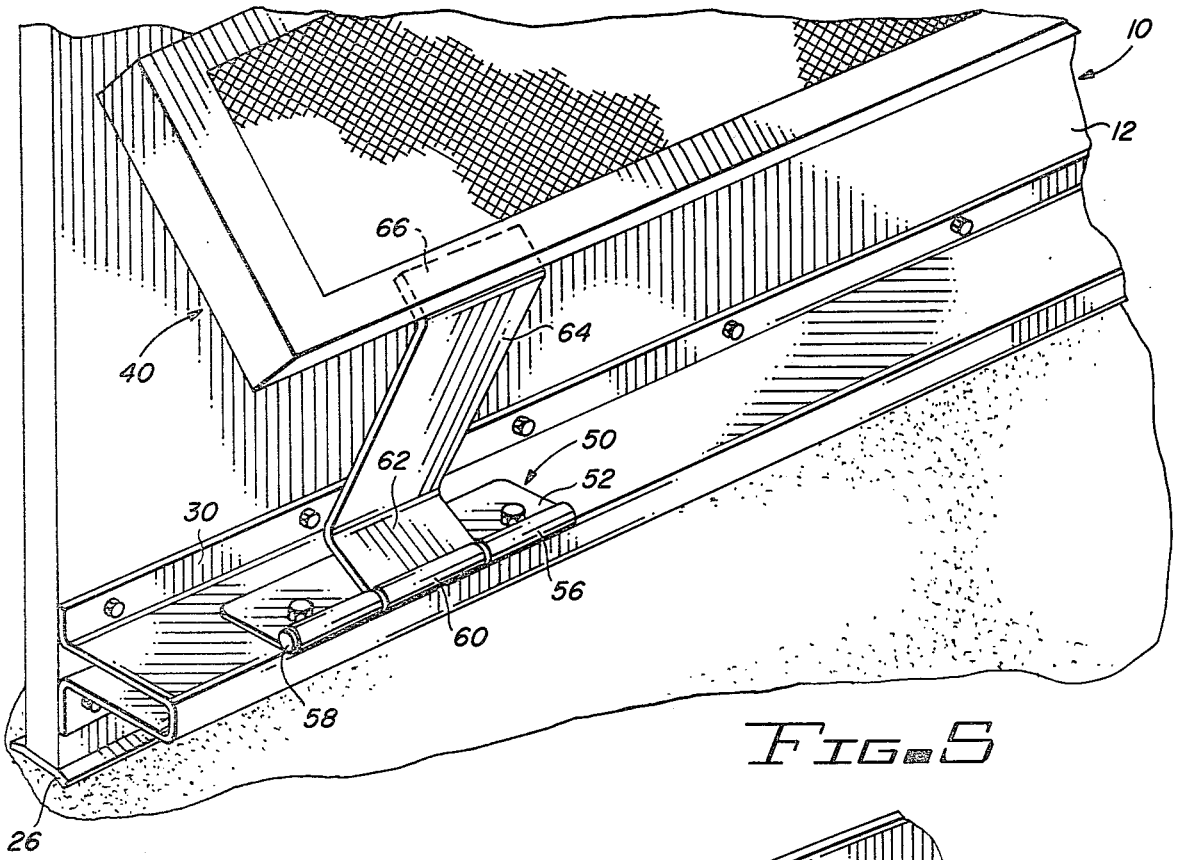
FIG. 5 is a perspective view of a portion of the apparatus of the present invention.
Figure 6:
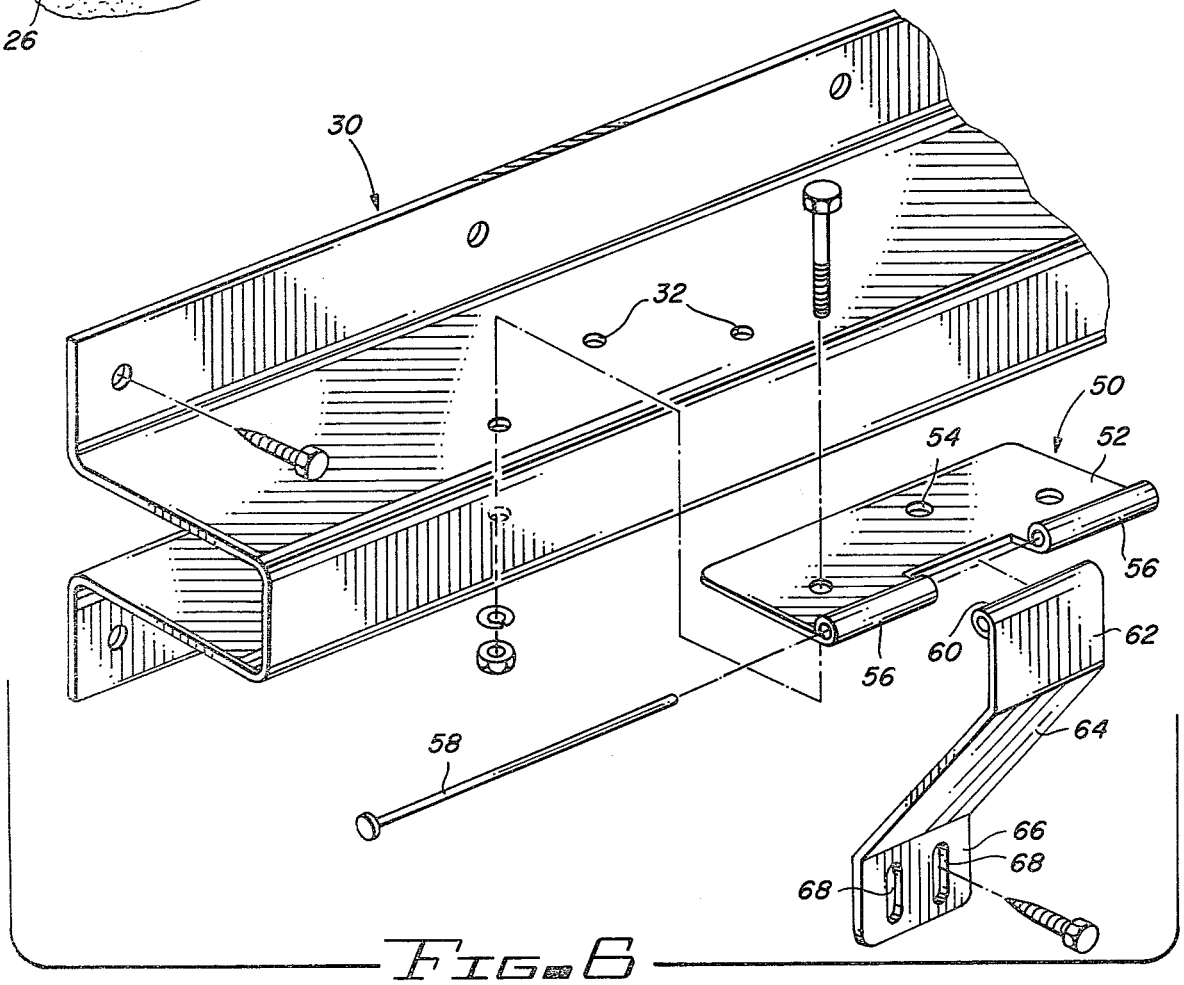
FIG. 6 is an exploded perspective view of a part of the apparatus of the present invention.

FIG. 1 comprises a perspective view of the exterior or outside of a garage 2, which has a door opening 4 for a garage door 10. The garage door 10 includes a screen panel 40 disposed at the bottom of the door 10. The front side of the door 10 and its screen panel 40 are shown in FIG. 1. FIG. 2 is a perspective view of the inside of the garage 2, and illustrates the inside of the garage door 10, and of the screen panel 40. The back or rear side of the door 10 and the screen panel 40 are shown in FIG. 2. FIG. 3 is a view in partial section of the door 10 and the screen panel 40, taken generally along line 3—3 of FIG. 2. FIG. 4 is a front view of a portion of the door panel 40, namely of a hinge 50 used to secure the panel 40 to the door 10. FIG. 5 is a perspective view of the door 10 and the panel 40, showing the screen panel 40 pivoted upwardly, away from its down or use position, as illustrated in FIGS. 1, 2, and 3, to its "up" position for storing purposes. FIG. 6 is an exploded perspective view of the hinge 50, illustrating how the hinge is secured to a portion of the door 10. For the following discussion, reference will be made to FIGS. 1, 2, 3, 4, 5, and 6.

The garage door 10 is shown in FIGS. 1 and 2 in its "down" or "closed" position in the opening 4. The door 10 is a sectional door, which normally moves between a pair of parallel tracks, not shown, on rollers (not shown) secured to the sides of the door, and generally disposed at the junctures of the panels.

The door 10 includes a lower or bottom panel 12, a second panel 16, a third panel 20, and an upper panel 22. The lower panel 12 includes a handle 4 secured to the exterior of the door for raising and lowering the door from the exterior of the garage 2. The panels of the door are appropriately secured together, as by a plurality of hinges 18, as shown in FIG. 2. It will be noted that the sectional doors, such as the door 10, may be made of either wood or metal. For metal doors, the hinges between panels are usually different from the hinges illustrated in the drawing. However, hinges for sectional garage doors are well known and understood. Regardless of the particular material out of which the doors are made, the screen panel apparatus 40 of the present invention may be utilized.

As best shown in FIG. 3, and in FIG. 5, a gasket 26 is usually disposed along the length of the bottom of the lower panel 12. The gasket 26 acts as a seal between the door and the bottom surface (floor) of the garage. In FIG. 2, the bottom surface of the garage is denoted by the letter F for floor. In FIG. 2, the bottom surface is denoted by reference letter D for driveway. Typically, both the garage door and the driveway are made of concrete. The gasket 26 insures that a seal will be made between the door in its down position and the floor F or the driveway D, to prevent water and debris, etc., from entering into the garage when the door is in its down position, or closed, as shown in FIGS. 1, 2, 3, and 5.

Extending transversely with respect to the garage door 10, or along the full width (or length) of the garage door 10, and along the back or rear side of the garage door 10, is a stiffener bracket 30. The screen panel 40 is hingedly secured to the stiffener 30. For metal doors, the stiffener 30 is generally an integral part of the door for stiffening purposes. The bracket or stiffener typically extends outwardly from the door a short distance, as shown in FIGS. 2, 3, 5, and 6. A stiffener may be a generally U-shaped bracket, as shown best in FIGS. 3, 4, and 6, or it may be of a Vee or triangular configuration, or any other configuration. For purposes of the present invention, the primary significance or difference that a particular design of stiffener bracket would make would be to require a more or less adjustment in the design configuration of part of the hinge elements used to secure the panel 40 to the door 10 through a bracket. This will be discussed below. For convenience in securing the panel 40 to wooden doors, a bracket such as the bracket 30 may be used.

The screen panel 40 includes an outer frame 42 with screen 44 secured to the frame 42. The frame 42 may be made of wood or of metal, as desired. For aesthetic purposes, it may be preferable to have the frame mode of wood for use with wooden garage doors, and to have the frame 42 made of metal for metal garage doors. Regardless of the particular material out of which the frame is made, the same basic principles and components as described herein apply.

The screen panel 40 may include a gasket, not shown, on the bottom of the frame 42, if desired.

The screen panel 40 includes a plurality of hinges 50 which are appropriately secured to the frame 42 and to the bracket or stiffener 30 for allowing the screen panel 40 to pivot into and out of engagement with the bottom of the garage door section or panel 12. As best shown in FIG. 5, when the panel 40 is moved to its up or storage position, it is completely out of the way of the lower door section 12, thus allowing the garage door to be completely closed. However, when use of the panel is desired for air circulation purposes within the garage 2, the screen panel 40 may be pivoted downwardly from its up, storage position shown in FIG. 5 to its down, use position as shown in FIGS. 1, 2, and 3. The presence of the screen panel 40 in its down position allows air to flow through the screen 44 and into the garage 2, but at the same time, the entry into the garage of animals, children, or the like, or debris, such as leaves and the like, is prevented. If desired, an appropriate pin connection, not shown, may be made between the bracket 30 and the hinge 50 to lock the panel 40 in its down position for security purposes from inside the garage. Obviously, other methods may also be used to appropriately secure the panel 40 to the bottom panel 12 of the garage door 10 to prevent the panel 40 from being inadvertently or deliberately pivoted away from the bottom of the door 10 which would allow undesired entry into the interior of the garage 2.

As best shown in FIGS. 4, 5, and 6, the hinge 50 includes a fixed plate 52 which is appropriately secured to the stiffener 30 as by a plurality of bolts or other fasteners. The fasteners extend through a plurality of apertures 54 in the fixed plate 52 and through appropriate mating apertures 32 in the stiffener 30. A pair of hinge cylinders 56 are shown disposed at one edge of the plate 52. The cylinders 56 are spaced apart and axially aligned to allow for the insertion between them of a mating hinge cylinder 60 of the movable strap portion of the hinge 50. The plate 50 is relieved to receive the mating hinge cylinder 60. A pin 58 extends through the hinge cylinder 56 and the hinge cylinder 60 to secure the two portions of the hinge 50 together. The screen panel 42 pivots on the pin 58.

The movable strap portion of the hinge 50 comprises three flanges, including a first flange 62, a second or intermediate flange 64, and a third flange 66. The third flange 66 includes a pair of vertically extending slots 68 through which are disposed a pair of screws or bolts, or other appropriate elements, for securing the hinge 50 to the door panel 40. The securing of the hinge to the panel 40 is best shown in FIG. 3.

The second or intermediate flange 64 extends at a diagonal with respect to the first flange 62 and the third or bottom flange 66. The flanges 62 and 66 are offset from each other. The flange 62 is secured directly to the cylindrical portion 60 through which the pin 58 extends. The hinge 50 comprises a modified tee hinge, with the strap portion of the tee hinge defined by the three flange portions. For descriptive purposes, and as best illustrated in FIG. 3 and in FIG. 6, the flange portions 62 and 66 are disposed substantially parallel to each other, but are spaced apart from each other in two dimensions, or offset, with the intermediate or connecting flange 64 extending diagonally downwardly and forwardly from the bottom of the flange 62 to the top or upper portion of the flange 66.

The hinge 50 allows the panel 40 to be secured to the stiffener 30 and to be aligned with, and to be disposed beneath, the bottom section 12 of the garage door 10 when the panel 40 is in the down or use position. In the up or storage position, as shown in FIG. 5, the configuration of the hinge 50 allows the panel 40 to be disposed against the door 10 for storage purposes. The term "storage" is used to denote the times other than when the screen panel is in its use, down position, as shown in FIGS. 1, 2, and 3. At other times, either when the "solid" sections of the garage door 10 are in their use position, with the bottom of the lower panel 12 disposed on the floor F of the garage 2, the panel 40 is "stored" against the door 10. With the panel 10 secured in its up or storage position, there is no interference with the door 10 in its full up or open position (not shown).

Generally speaking, the use of a modified tee hinge, as opposed to a butt hinge, is preferred. This allows the panel 40 to be pivoted directly below, and aligned with, the bottom panel of a sectional garage door. It also allows the panel 40 to be pivoted upwardly, out of the way of the bottom of the garage door. Furthermore, the modified, offset hinge permits the bottom of the door 10, via its gasket, if it has one, to be completely closed, downwardly, against the garage floor F. The term "modified" simply indicates that the hinge will generally have an offset portion to compensate for the lateral spacing between the panel 40 in its down position, beneath the lowest door panel or section 12, and the location at which the hinge is secured, either directly or through a stiffener, to the door 10. Under some circumstances, as when no stiffener is used with a wooden panel sectional door, no offset portion, or only a small offset portion, of a hinge may be necessary.

Various types of fasteners, such as a click-lock hasp (not shown), may be used to secure the panel 40 in its up or storage position against the door 10.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Screen panel apparatus for a sectional garage door comprising, in combination:

a sectional garage door movable between an up position and a down position, and including a first section adapted to contact a garage floor when the door is in its down position;

a screen panel extending substantially the full width of the first section of the garage door; and hinge means secured to the first section of the garage door and to the screen panel for pivoting the screen panel between a down position beneath the first section and an up position against the first section.

2. The apparatus of claim 1 in which the hinge means includes a bracket secured to the first section of the garage door.

3. The apparatus of claim 2 in which the hinge means further includes a hinge secured to the bracket and extending from the bracket to the screen panel for pivoting the screen panel from its up position against the first section to its down position beneath the first section.

4. The apparatus of claim 3 in which the hinge includes an offset portion adapted to allow the screen panel to be disposed beneath and aligned with the first section of the garage door.

* * * * *